US005184820A

United States Patent [19]

Keating et al.

[11] Patent Number: 5,184,820

[45] Date of Patent: Feb. 9, 1993

[54] HOCKEY PUCK

[76] Inventors: Michael D. Keating, Oakdale; Robert W. Norris, Minneapolis, both of Minn.

[21] Appl. No.: 277,957

[22] Filed: Nov. 30, 1988

Related U.S. Application Data

[63] Continuation of Ser. No. 33,011, Mar. 31, 1987, abandoned.

[51] Int. Cl.[5] ..... A63B 71/00

[52] U.S. Cl. ..... 273/128 R

[58] Field of Search ..... 273/126 R, 128 R, 128 CS

[56] References Cited

U.S. PATENT DOCUMENTS

| | | | |
|---|---|---|---|
| 1,013,074 | 12/1911 | Schutz | 273/128 R |
| 2,511,147 | 6/1950 | Braun | 273/128 R |
| 2,606,030 | 8/1952 | Tjomsland | 273/128 R |
| 2,623,748 | 12/1952 | Lucero | 273/128 R |
| 2,640,699 | 6/1953 | Garbo | 273/128 R |
| 3,188,088 | 6/1962 | Gatke | 273/128 CS |
| 3,533,626 | 10/1970 | Smith | 273/126 R |
| 3,610,625 | 10/1971 | Enro et al. | 273/126 R |
| 3,675,928 | 7/1972 | Gentile | 273/128 R |
| 3,784,204 | 1/1974 | Felber | 273/128 R |
| 4,111,419 | 9/1978 | Pellegrino | 273/128 R |
| 4,218,062 | 8/1980 | Brooks | 273/126 R |

FOREIGN PATENT DOCUMENTS

| | | | |
|---|---|---|---|
| 527738 | 7/1956 | Canada | 273/128 R |
| 680107 | 2/1964 | Canada . | |

*Primary Examiner*—Theatrice Brown

*Attorney, Agent, or Firm*—John C. Barnes

[57] ABSTRACT

A hockey puck having a conventional shape and opposite end surfaces, each formed with at least three symmetrically spaced projections preferably having a lower coefficient of friction than the body of the puck. A ring or band of material of a color differing from the remainder of the puck about the periphery of the puck and flush with the periphery of the puck.

11 Claims, 1 Drawing Sheet

HOCKEY PUCK

This is a continuation of application Ser. No. 033,011 filed Mar. 31, 1987, now abandoned.

BACKGROUND OF THE INVENTION

1. Field of the Invention

This invention relates to an improvement in a sports game piece, and in one aspect, to an improved hockey puck for the game of ice hockey.

2. Description of the Prior Art

Hockey pucks have traditionally been the same black cylindrical shape, about 3 inches in diameter, and one inch thick, weighing about 5½ to 6 ounces. The outer cylindrical edge is knurled or ribbed with ridges and grooves following a generally helical path. They are generally formed of vulcanized rubber. Major manufacturers of the conventional pucks are the Viceroy Manufacturing Company and the Sherbrooke Drolet Company.

The traditional black hockey puck will cause black marks to form on the transparent wall of plexiglass surrounding the rink above the boards when the puck strikes the wall, and continual maintenance to clean the same for the spectators is required.

Further, the standard hockey puck becomes slower as the ice is worn, developing a snow condition, making the control of the puck more difficult for the players. The roughened and loosened ice slows the traditional puck as it has a snow plowing effect as it is moved over the ice and, at that time, greater attention by the player is required to maintain control of the hockey puck.

Hockey players tape the blade of the hockey sticks and this is usually done with a black tape. Such tape with the black puck makes the puck harder to see coming off the stick. Having a puck which is harder to see against the black background of the tape is thus more dangerous to players and fans. The hockey puck of the present invention meets the size and weight requirements of the standard hockey puck which is regulation with the game. The hockey puck of the present invention reduces the snow plowing effect that the hockey puck has with the ice, and particularly, as the ice becomes loosened and a snow develops on the surface. The hockey puck of the present invention moves more consistently and rapidly on the ice and affords greater control of the puck by the hockey player.

SUMMARY OF THE INVENTION

The hockey puck of the present invention comprises a 5½ to 6 ounce cylindrical object 3 inches in diameter and one inch thick. The puck is provided with an outer cylindrical side surface which may be conventionally knurled to increase the frictional surface of the outer side wall. The puck is provided with axially spaced end walls, each being formed with at least three symmetrically circumferentially spaced projections having a rounded or arcuate profile. In a preferred embodiment the projections, and end walls, have a coating of material having a lower coefficient of friction than the material of the hockey puck. A preferred coating is polytetrafluoroethylene. A ring or band of a material, formed of the same material as the puck, but of a color different than the puck is inset in the puck around the central portion of the periphery of the side wall of the puck. The entire side wall of the puck including the band is knurled.

BRIEF DESCRIPTION OF THE DRAWINGS

The present invention will be further described with reference to the accompanying drawing wherein.

DESCRIPTION OF THE PREFERRED EMBODIMENTS

Figure 1:
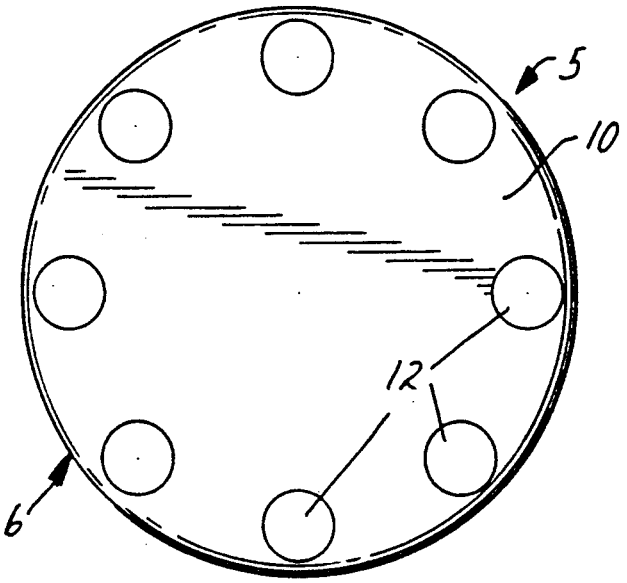
FIG. 1 is a top plan view of the hockey puck, the bottom view is the same.
Figure 2:
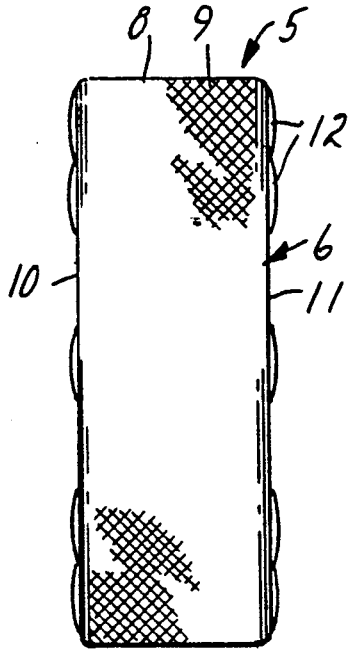
FIG. 2 is a side elevational view of the hockey puck.

The present invention provides an improved hockey puck, generally designated 5, having a body 6 of the conventional circular or cylindrical shape with a thickness of about one inch (2.54 cm) and 3 inches (7.62 cm) in diameter. The outer cylindrical edge 8 of the puck is formed with ridges and grooves or a knurled surface, affording increased friction as designated by the knurled pattern 9.

Figure 3:
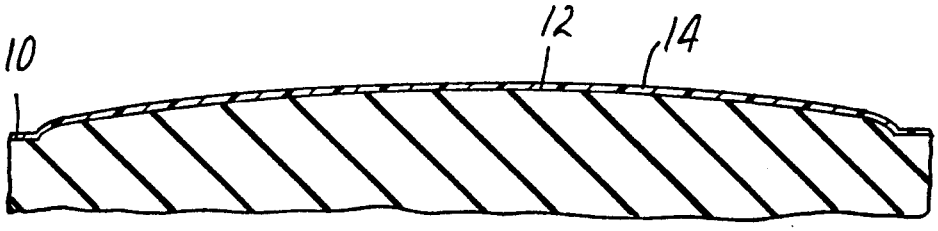
FIG. 3 is a detailed fragmentary elevational view of one of the projections on one end of the hockey puck.

Projecting from each of the end surfaces 10 and 11 are a plurality of arcuate projections 12 positioned adjacent the outer wall and spaced symmetrically with respect to the periphery of the surface. Each projection has a height of between about 0.01 to 0.04 inch (0.25 to 1 mm), preferably 0.020 to 0.025 inch (0.5 to 0.6 mm) above the surface and has a radius of between 0.05 to 0.25 inch (1.27 to 6.35 mm) preferably 0.187 inches (4.75 mm). The projection is generally domed-shaped or arcuate, and, as illustrated in FIG. 3, the profile is not formed on a predetermined center but tapers from the center point toward each of the edges of the projections. There are at least 3 projections 12, but, preferably 8 projections are spaced equally about the center.

The center of the projection is about 1.25 inches (3.17 cm) from the center of the hockey puck, and the total thickness of the hockey puck from the top of one projection on one side 10 to the top of the projection 12 on the other side 11 is about 1.032 inches (2.62 cm).

These projections and the end, as illustrated in FIG. 3, are preferably provided with a coating 14 of polytetrafluoroethylene, affording a coefficient of friction for the projections and end walls which is less than the coefficient of the material forming the body of the hockey puck.

Figure 4:
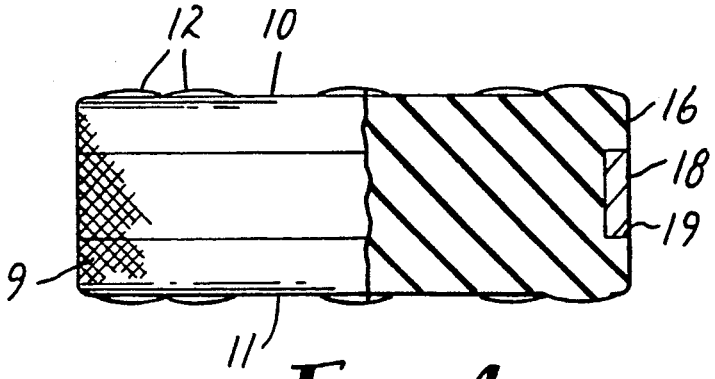
FIG. 4 is a vertical fragmentary sectional view of a further embodiment of a hockey puck constructed according to the present invention.

In FIG. 4 there is illustrated a second embodiment of a hockey puck constructed according to the present invention wherein the body 16 is molded with a band 18 of material formed of a color differing from the black of the puck. This band is formed of the same material as the puck but has a pigment added to give it a fluorescent color, orange or green. The band 18 is 0.500±0.003 to 0.510±0.005 inch wide (1.27 to 13 mm) and is in a groove 19 0.125±0.010 inch (3 to 3.3 mm) deep. The band 18 is flush with the edge wall. The edge wall and band 18 are both knurled. The band 18 provides higher visibility of the puck, for the players and for the fans.

The body 6 or 16 of the puck may be formed of vulcanized rubber as is standard, but is preferably formed of a mixture of material having a durometer measure similar to that of vulcanized rubber. The example of a material is:

| Product | Supplier | Parts by Weight |
|---|---|---|
| Copo 1502 | Copolymer Inc. | 100 |
| Hard clay | | 37.5 |
| Cumar Resin H2.5 | | 5 |
| Carnauba Wax | | 2 |
| Zinc oxide | | 5 |
| Stearic acid | | 1 |
| Sulfur | | 10 |
| Methyl tuads | R. T. Vanderbilt | 0.6 |
| Altax | | 2 |
| Carbon black N550 | | 2 |
| Whiting | | 37.5 |

Other suitable polymeric material may be suitable thermoplastic rubbers (TPR) having a durometer measure of 65 to 90. The band 18 is place into the grove 19 and is also formed of the same material except the pigment is a fluorescent pigment of orange or green and not carbon black.

Having thus described the invention what is claimed is;

1. A hockey puck having a body of a circular shape and thickness of a conventional hockey puck, said body having oppositely projecting spaced ends, characterized in that each end has at least three symmetrically circumferentially spaced projections formed integrally with said body on said ends and extending therefrom and terminating in an arcuate shape.

2. A hockey puck according to claim 1 wherein said projections have a coating of material with a lower coefficient of friction than the material of the body of the hockey puck.

3. A hockey puck according to claim 2, wherein said coating is polytetrafluoroethylene.

4. A hockey puck according to claim 1 wherein said projections extend from said ends by about 0.01 to 0.04 inch.

5. A hockey puck according to claim 4 wherein said projections extend from said ends between about 0.02 and 0.025 inch.

6. A hockey puck according to claim 1 wherein there are eight projections which are domed-shaped symmetrically spaced near the periphery of each end.

7. A hockey puck having a body of a shape, size, weight and thickness to meet the specifications for a regulation hockey puck, said body having opposite circular ends and a peripheral edge wall connecting said ends, said edge wall having a groove extending circumferentially of said body, a band of material similar to the material of said body and comprising a pigment of a color other than said body disposed in said groove, said band having an outer surface flush with the peripheral edge wall of said body, and said body having at least three symmetrical circumferentially spaced arcuate projections extending from each of said circular ends and formed integrally with said body.

8. A hockey puck according to claim 7 wherein said arcuate projections are dome-shaped and each projection has a center which centers are spaced around the end about 1.2 inch from the center of each said circular end.

9. A hockey puck according to claim 8 wherein said projections extend from said ends between about 0.020 and 0.025 inch.

10. A hockey puck according to claim 7 wherein said ends are coated with polytetrafluoroethylene.

11. A hockey puck according to claim 7 wherein said projections extend from said ends between about 0.02 and 0.025 inch.

* * * * *